United States Patent [19]

Regenos et al.

[11] 4,103,303

[45] Jul. 25, 1978

[54] FREQUENCY SCANNED CORNER REFLECTOR ANTENNA

[75] Inventors: Kenneth M. Regenos, Palo Alto; Normand Barbano, Sunnyvale, both of Calif.

[73] Assignee: The United States of America as represented by the Secretary of the Army, Washington, D.C.

[21] Appl. No.: 735,478

[22] Filed: Oct. 21, 1976

[51] Int. Cl.[2] ..... H01Q 3/26; H01Q 19/16

[52] U.S. Cl. ..... 343/100 SA; 343/814; 343/815; 343/854

[58] Field of Search ..... 343/100 SA, 814, 815, 343/835, 854

[56] References Cited

U.S. PATENT DOCUMENTS

| | | | |
|---|---|---|---|
| 3,039,097 | 6/1962 | Strumwasser et al. | 343/854 X |
| 3,083,360 | 3/1963 | Welty et al. | 343/100 SA |
| 3,202,997 | 8/1965 | Schell | 343/854 X |
| 4,001,837 | 1/1977 | Reggnos et al. | 343/854 |

*Primary Examiner*—Maynard R. Wilbur
*Assistant Examiner*—Richard E. Berger
*Attorney, Agent, or Firm*—Nathan Edelberg; Robert P. Gibson; Freddie M. Bush

[57] ABSTRACT

The frequency scanned corner reflector antenna is a modified corner reflector antenna that incorporates a feeding technique to achieve monopulse or sequential lobing radiation patterns in one principal plane and one or more frequency-scanned beams in the other principal plane. Scanning of the beam of the corner reflector antenna for direction finding and tracking applications is accomplished without destroying the unique monopulse and sequential lobing capabilities of the antenna.

5 Claims, 22 Drawing Figures

FREQUENCY SCANNED CORNER REFLECTOR ANTENNA

DEDICATORY CLAUSE

The invention described herein was made in the course of or under a contract or subcontract thereunder with the Government and may be manufactured, used, and licensed by or for the Government for governmental purposes without the payment to us of any royalties thereon.

BACKGROUND OF THE INVENTION

Frequency scanning methods are used where rapid and accurate target tracking data is required. Frequency scanning allows a portion or all of the regions being scanned to be covered by changes in the radiated beam frequency, which allows electronic beam steering to occur. Corner reflectors and frequency scanning arrays are disclosed in detail in prior art literaure such as in Chapter 13 of the "Radar Handbook" by M. I. Skolnik, McGraw-Hill Book Company, 1970.

SUMMARY OF THE INVENTION

The frequency scanned corner reflector antenna provides electronic scanning of the antenna beam for direction finding and tracking applications. The corner reflector antenna is fed such that one or more beams may be formed in the plane parallel to the corner reflector surfaces which may be moved in that plane by changing the frequency and at the same time forming monopulse or sequential lobing radiation patterns in the plane perpendicular to the corner reflector surfaces.

DESCRIPTION OF THE PREFERRED EMBODIMENT

Figure 1:
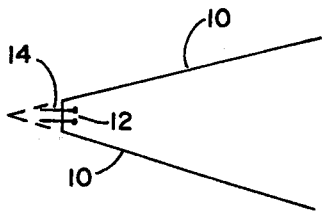
FIG. 1 is a simplified diagrammatic top view of a corner reflector antenna.
Figure 2:
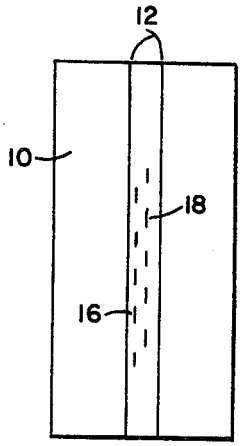
FIG. 2 is a diagrammatic front view of the antenna of FIG. 1 showing the arrangement of the dipole antenna elements.

Referring now to the drawings wherein like numbers refer to like parts in the drawings, FIG. 1 discloses a top view of a corner reflector havig two planar surfaces 10 joined by an acute included angle. A dipole array 12 is disposed in the throat 14 of the angle between the reflector for transmitting and receiving radiation. FIG. 2 discloses the dipole array 12 to be comprised of two columns of antenna elements 16 and 18 with each element being staggered with respect to the other elements so that only one antenna dipole element lies in a given horizontal plane.

These elements are fed with linearly-tapered outer coaxial line balun made of semi-rigid coaxial line. The VSWR of the dipoles assembled in the reflector does not exceed 1.26:1, and the average value at selected frequencies in the radar S-band frequency range is well below 1.20:1. This includes mutual coupling effects. The separation between element rows was determined to give the best elevation patterns. This element spacing is approximately 0.533λ, which can be changed to about 0.4λ to avoid large grating lobes during a sequential lobing mode.

Figure 3:
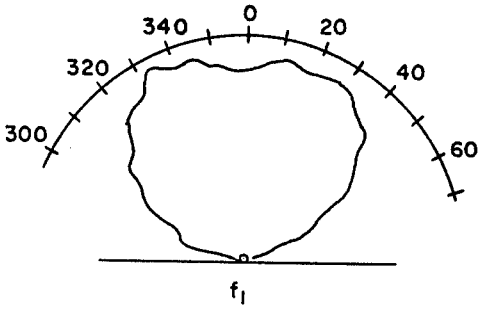
FIGS. 3, 4, and 5 are typical azimuth radiation patterns of a dipole located at the center of the array.
Figure 4:
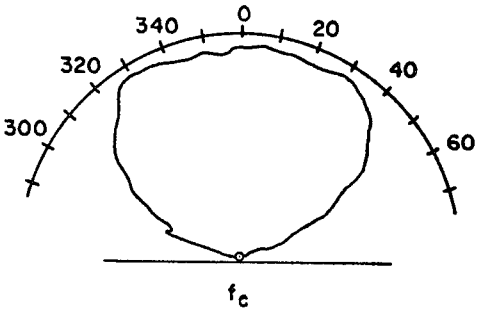
Figure 5:
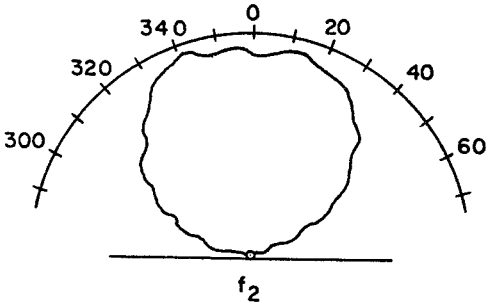
Figure 6:
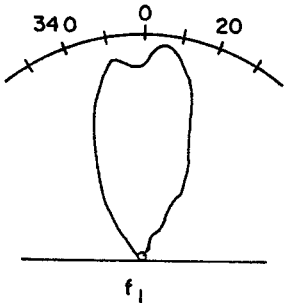
FIGS. 6, 7, and 8 are typical elevation patterns of a dipole located at the center of the array.
Figure 7:
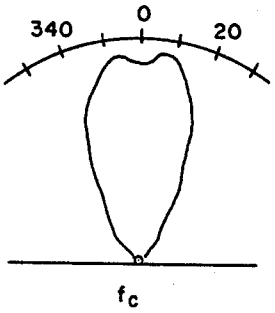
Figure 8:
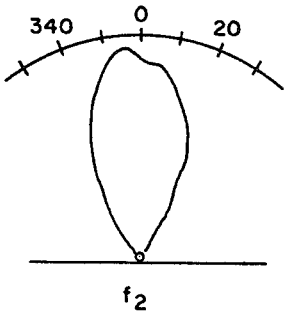

The typical element patterns of a dipole located at the center of the array are shown in FIGS. 3–8. The E-plane (azimuth) patterns of FIGS. 3, 4 and 5 show that the half-power beamwidth varies by several degrees and that the patterns are not well-behaved as a signal dipole over a flat ground plane. This is due primarily to the mutual coupling effects from adjacent dipoles. The H-plane (elevation) patterns of FIGS. 6, 7, and 8 show a large dependence on the corner reflector. The pattern asymmetry is due to the displacement of the dipole element from the center of the reflector. In these radiation patterns $f_1$ represents the lower frequency which is radiated, $f_c$ represents the center frequency, and $f_2$ represents the upper frequency of the band of frequencies which may be scanned.

Figure 9:
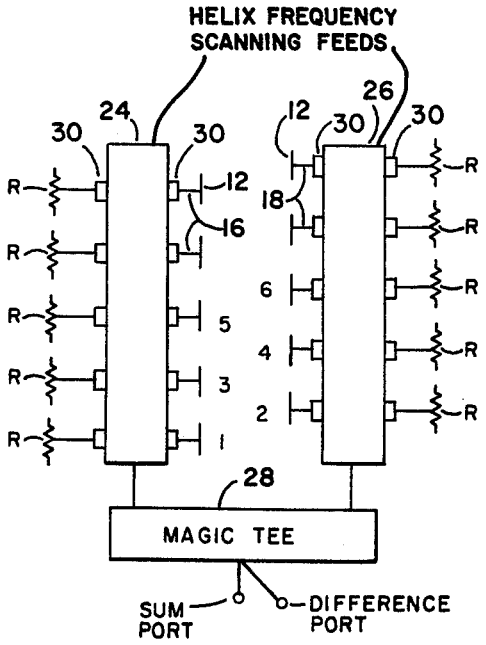
FIG. 9 is a schematic diagram of the beam forming network of the antenna.

In the schematic of FIG. 9, dipole array 12 is shown with each of the dipole elements 16 coupled to respective directional coupler output pairs 30 on a helix frequency scanning feed 24. Similarly, dipole elements 18 are coupled to directional coupler output pairs 30 on a helix frequency scanning feed 26. Thus, both columns of dipoles are fed from a helix to provide the antenna beam scanning mode of operation. A common end of each helix frequency-scanning feed is coupled to a magic tee 28 for providing a sum and difference pattern output for monopulse operation in the elevation plane.

The helix frequency scanning feed is compact and capable of high power operation at UHF. The feeds 24 and 26 allow the main lobe of the radiation pattern to be broadside to the antenna aperture at a center frequency $f_c$. The feed coupler values allow an exponential amplitude distribution to be obtained across the dipole array.

Measurements at the center frequency on this shielded helix line show that the phase velocity, parallel to the helix, is 0.91 times the velocity of light in free space. Over the frequency band from $f_1$ to $f_2$ the electric field distribution is confined between adjacent turns of the helix. The retardation factor, R, which expresses the ratio of the change in scan angle to the per cent change in frequency, is 10.1. The shielded helix is connected at both ends with an S-band waveguide-to-helix transition.

Five power distribution couplers 30 are used on each helix frequency scanning feed. The spacing between these couplers has a wavelength spacing which compares with the dipole spacing in each row and provides an almost perfect alignment between the output ports of the couplers to the dipoles. To achieve an exponential amplitude taper across the dipoles with both units connected, the couplers were chosen to have identical coupling values of −15 db.

The directional couplers 30 are quarter wave-wavelength components constructed on strip line. The length of the transmission line is determined by the relationship, $l = (\lambda g/4\sqrt{\epsilon})$ where $\lambda g$ is the wavelength in the helix shield and $\epsilon$ is the dielectric constant of the strip-line dielectric. Typically for $f_c = 3.5$ GHz, $\lambda g$ is 3.161 inches and $\epsilon$ is 2.414; therefore, the length, $l$, is 0.508 inch. The thickness of the dielectric is 0.0585 inch and the width of the line is 0.416 inch. This relationship gives a good VSWR response for the coupler. The measured VSWR is less than 1.1:1 across the band. The directional couplers are all tilted 9.37° from the normal to the axis of the helix and in the opposite direction of the helix pitch angle. These couplers are set in place flush against the wall of the shield; therefore, they simulate a circular shape. The inner terminals of each coupler are connected to the dipoles, and the outer terminals are each terminated in a 50-ohm load, R. The measured coupling is very close to −15 db at $f_c$. The directivity also averages about 15 db across the band.

The beamforming network of FIG. 9 provides the frequency scanning operation in the azimuth plane and the monopulse operation in the elevation plane. The elevation sum and difference patterns are formed simply by connecting the signal receiver or generator to either the sum port or the difference port of magic tee 28. The output of the device also divides the power; however, it introduces a 180° phase shift between the output ports. The helices of the two feed devices are contra-wound, providing convenient mounting with the antenna dipoles.

The sum and difference ports are coupled through the helix feeds to the same side of each antenna element. This allows the generated beam to scan clockwise with an increase in frequency, for example, with the power being equally divided between the two helix scanning feeds. As the signal power advances through the helix feeds, input signals are coupled to the antenna elements through respective couplers. At the center frequency, $f_c$, of operation the signals at each dipole element are in phase and the generated beam is located broadside to the antenna aperture, resulting in a zero degree shift at the center frequency. As the input frequency is decreased to a lower limit, $f_1$, or increased to an upper limit, $f_2$, the beam will scan in either direction from broadside (zero degrees). This allows a sector within an acute angle of the antenna to be efficiently scanned without physically moving the antenna array.

Figure 10:
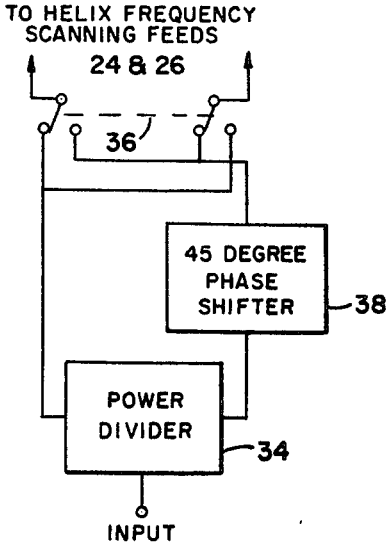
FIG. 10 is an alternative embodiment for providing the sequential lobing mode of operation.

The network used for the sequential lobing mode of operation is shown in FIG. 10. A power divider 34 is used at the frequency input, and the two outputs from the divider go, typically, to a double poledouble throw switch 36. One output of the divider is coupled through a 45° phase shifter 38 to one line of the switch. From the switch, the two signal paths lead up to the helix frequency-scanning delay lines where both rows of dipoles are fed simultaneously. Alternately switching the phase delay, from one line to the other line, squints the pattern in one direction in the H-plane and then the other by the same angle.

As shown in FIGS. 11–22 radiation power patterns of the antenna are provided for frequencies $f_1$, $f_c$, and $f_2$. This data consists of azimuth and elevation patterns for the two modes of operation. In the initial measurements, the relationship between frequency and the scan angle of the main beam are determined from the azimuth patterns. With this information, the elevation patterns are measured in the plane at which the maximum of the azimuth beam occurs. As viewed from above the antenna, the beam scans clockwise, away from the feed end, with a slightly accelerating rate with increasing frequency. The total scan angle is 28 degrees for a frequency change of 200 MHz in the S-band, and at the center frequency $f_c$, the scan rate is approximately 0.15° per Megahertz.

Three sets of radiation patterns measured on the antenna describe the performance of the monopulse operation. The first set is the sum beam patterns from which the scanning information derives; the second set is the sum and difference elevation patterns; and the third set is the difference beam patterns as measured in the azimuth plane. In addition, the cross-polarized patterns were measured.

Figure 11:
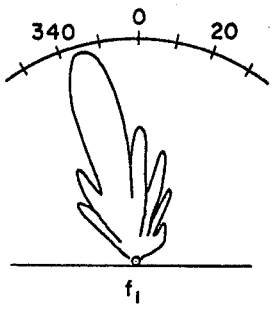
FIGS. 11, 12, and 13 are azimuth sum beam radiation patterns for low, center, and high frequency antenna radiation patterns.
Figure 12:
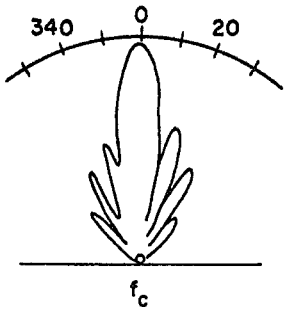
Figure 13:
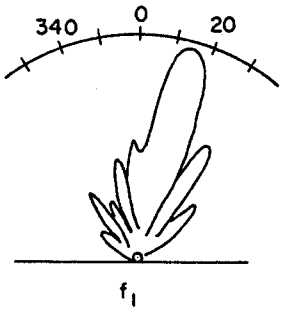

Features of the sum beam patterns are shown in FIGS. 11, 12, and 13. The half-power beamwidth variation is less than ½° across the band (from $f_1$ to $f_2$) and has a value of 10 degrees at the center frequency, $f_c$. The resulting total pattern gain variation is less than 1 db. The beamwidth correlates closely to theoretical values with the effective length of the antenna taken to be that of the dipole array. This indicates that the apparent phase center location in the azimuth plane of the antenna must be inside the throat and near the dipole array.

The side-lobe levels are nominally −12 db down from the peak of the beam. The cross-polarized component is down −27 db in the worst case. It is also noted that the higher sidelobes occur on the opposite side of the main lobe from which the array is fed. Outside of the sector, ±60°, about the normal to the array, the sidelobes lie below −32 db. The polarization of the third sidelobes were examined and found to be purely linear like the main lobe.

Figure 14:
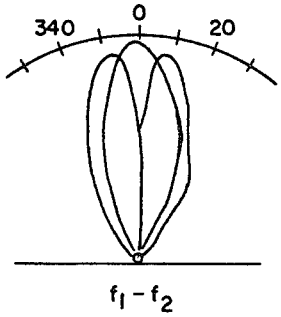
FIG. 14 is a monopulse radiation pattern in the elevation plane which is typical across the radiation frequency band from $f_1$ to $f_2$.
Figure 15:
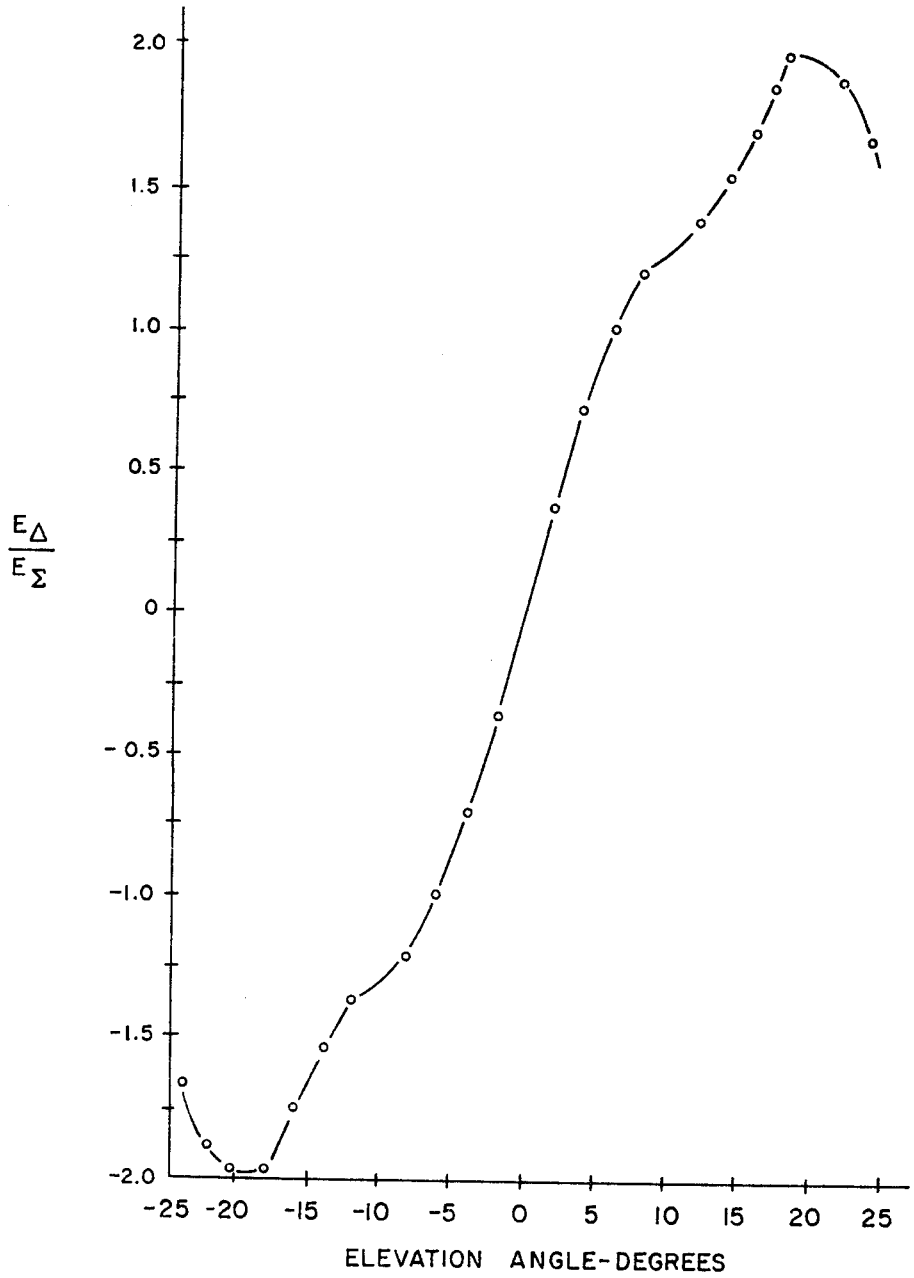
FIG. 15 is the elevation error slope for monopulse operation at $f_c$.

The elevation, monopulse radiation pattern is shown in FIG. 14, and these form the basis for determining a target location in elevation. This pattern has negligible change across the band of operation. The amplitude of the difference pattern lies between −2 and −3 db below that of the sum beam (FIGS. 11, 12, and 13), and its null depth is below −32 db. The amplitudes of the received signals on the sum and difference patterns are compared by taking their voltage ratio. This also determines a unique elevation angle since the lobes of the difference beam are of opposite polarity. A plot of the voltage ratio of the difference pattern to the sum pattern as a function of elevation angle is shown in FIG. 15. This plot shows that accurate direction finding can be performed over the elevation sector, ±18°, as measured from the normal to the face of the antenna.

The half-power beamwidth of the sum beam at the center frequency is 12° (FIG. 12). The elevation aperture is 6.7 wavelengths wide at $f_c$, and with a cosine-squared amplitude distribution, the half-power beamwidth corresponds essentially to that of a horn antenna. Therefore, the apparent phase center location in this plane is very close to the aperture of the corner reflector.

The sidelobes are at least −25 db below the peak of the beam, and outside of the scan sector, ±40°, the side and back lobes are below −32 db. These low side levels indicate a reduced probability of obtaining false target indications and also a reduced level of received noise or interference.

Figure 16:
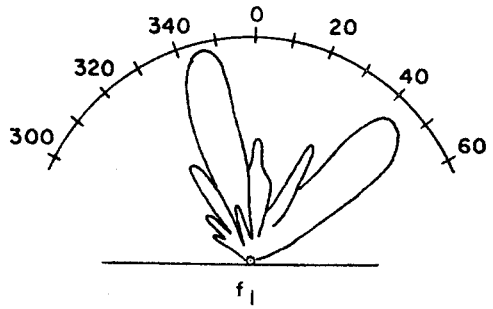
FIGS. 16, 17, and 18 are azimuth difference beam radiation patterns for low, center, and high frequency antenna radiation patterns.
Figure 17:
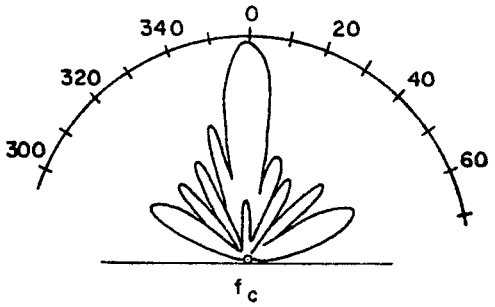
Figure 18:
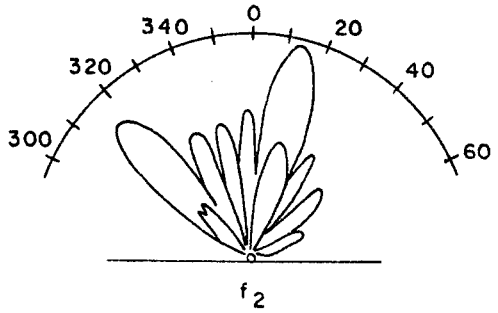

A set of azimuth antenna patterns for the difference beam is shown in FIGS. 16, 17, and 18. These measurements were taken with the antenna tilted upwards 7.5 degrees from the horizontal so that the patterns could be measured through the peak of the lower beam. The half-power beamwidth in this case is 9.5° at the center frequency $f_c$. The results show that peak of the beam tracks the sum beam over the entire frequency band, but there is a noticeable difference in that grating lobes appear in the patterns. These lobes are present because of the 180° phase additin to one row of the dipoles. They tend to get quite large at the two ends of the band ($f_1$ and $f_2$) and are even present at the center frequency. The amplitude of the grating lobes is lower at the center frequency because of the dipole element pattern response which is down at the angle at which the grating lobes appear. These grating lobes can be readily eliminated by using a closer interelement spacing. The existing grating lobes do lie outside of the scan sector of interest so there are no ambiguities while tracking a target in this sector.

Figure 19:
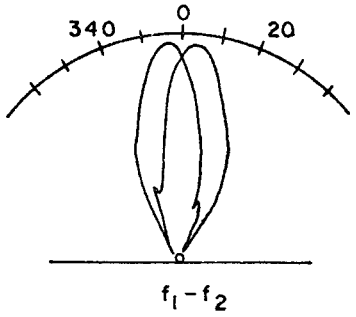
FIG. 19 is a typical sequential lobe radiation pattern in the elevation plane.

The sequential lobe elevation and azimuth patterns are shown in FIGS. 19, 20, 21, and 22. The single elevation pattern of FIG. 19 is typical of the pattern obtainable across the band and was measured by first forming one beam by adding a 45° phaseshift in series with one delay line and then repeating the process with the other delay line The two elevation beams may be seen to cross over at the nearly constant level of −1.5 db below the peak of the beams. These two patterns are symmetrical about the normal to the face of the antenna aperture, and their peaks are squinted from this normal by 3.5°. The half-power beamwidths of the two lobes at mid-frequency are 11.2°, and the relative gain variation is about 1 db across the frequency band, $f_1$ to $f_2$. The highest side-lobe level that occurs is −21 db down from the peak of either beam. Outside of the elevation angular sector, ±40°, the pattern lobes are below −32 db down.

Figure 20:
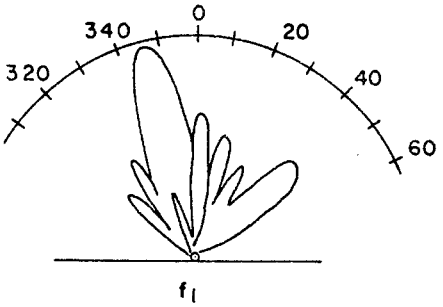
FIGS. 20, 21, and 22 are sequential lobe radiation patterns in the azimuth plane.
Figure 21:
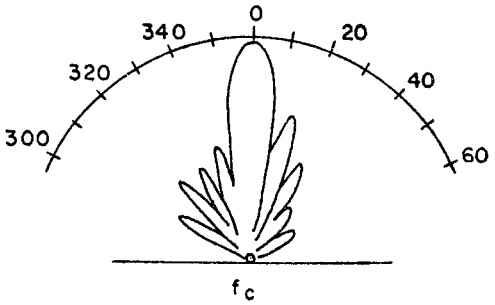
Figure 22:
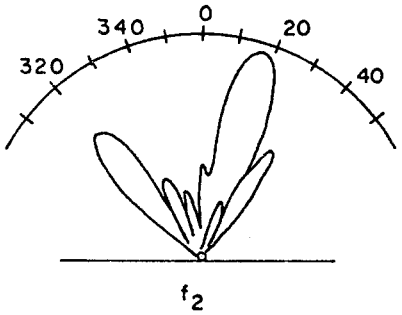

The azimuth pattern cuts were adjusted to pass through the lower elevation beam maximum by tilting the antenna back 3.5°. These patterns track the monopulse patterns identically. The half-power beamwidths of the patterns in FIGS. 20, 21, and 22 are about 10°. The sidelobe structure of these patterns differs from the other azimuth patterns because of the 45° phase shift. Grating lobes still appear at large scan angles off of the normal of the array; however, the amplitude is much lower than the grating lobes that appear in the difference patterns. The largest sidelobe occurs on the side of the pattern away from the feed, and its amplitude is −10 db down from the peak of the beam. The crossed-polarized pattern is down −22 db in the worst case. Outside of the azimuth sector, ±70°, the sidelobes (including the back lobe) all lie below −32 db.

A related invention entitled "Dual Scan Corner Reflector Antenna" by Kenneth M. Regenos and Normand Barbano, the inventors of the instant invention, is currently pending before the US Patent and Trademark Office. This related application, filed Jan. 9, 1976 and given Ser. No. 647,694 is now U.S. Pat. No. 4,001,837 issued Jan. 4, 1977.

While the invention has been described in connection with certain specific embodiments thereof, it should be understood that further modifications will suggest themselves to persons skilled in the art and it is intended to cover such modification as may fall within the scope of the claims appended hereto.

We claim:

1. A frequency scanned corner reflector antenna comprising: first and second planar microwave reflector surfaces disposed for forming a throat at an acute angle therebetween, a plurality of dipole antennas uniformly disposed in columns in said throat for radiating and receiving microwave energy, a first helix frequency scanning feed coupled to a first portion of said dipole antennas for coupling microwave energy thereto, a second helix frequency scanning feed coupled to a second portion of said dipole antennas for coupling microwave energy thereto, signal dividing means coupled to both of said helix feeds for simultaneously coupling microwave energy to and from said feeds for providing antenna frequency scanning in a clockwise or a counterclockwise direction when input signal frequency is increased or decreased respectively.

2. A frequency scanned corner reflector antenna as set forth in claim 1 wherein said signal dividing means is a magic tee having first and second input-output ports coupled to said first and second helix feeds respectively for providing frequency signals thereto, a sum port and a difference port for providing microwave energy therethrough.

3. A frequency scanned corner reflector antenna as set forth in claim 2 and further comprising a plurality of directional couplers coupled between ports of said helix feeds and respective dipole antenna elements for providing a matched line between the dipole elements and the respective helix feeds.

4. A frequency scanned corner reflector antenna as set forth in claim 1 wherein said signal dividing means is a power divider having an input port and having first and second output ports coupled as inputs to respective first and second helix feeds.

5. A frequency scanned corner reflector antenna as set forth in claim 4 and further comprising a double pole, double throw switch and a phase shifter coupled between the respective outputs of said power divider and the inputs of said helix feeds for switching the output signals of said power divider alternately between said helix feeds, said first output of said power divider being coupled to the first pole of said switch, and said phase shifter being coupled between the second output of said power divider and the second pole of said switch for phase shifting the signal coupled on one output path with respect to the other output path to provide a sequential lobing mode of operation.

* * * * *